US007625224B2

(12) United States Patent
Jaouen et al.

(10) Patent No.: US 7,625,224 B2
(45) Date of Patent: Dec. 1, 2009

(54) RAPID-INSTALLATION CONNECTOR FOR AN ARMORED CABLE

(75) Inventors: Jean-Marc Jaouen, La Sonc (FR); Didier Revol, Chatte (FR); Vincent Laroche, Saint-Marcellin (FR); Nathalie Foratier, Saint Antoine I'Abbaye (FR)

(73) Assignees: Legrand France, Limoges (FR); Legrand SNC, Limoges (FR)

( * ) Notice: Subject to any disclaimer, the term of this patent is extended or adjusted under 35 U.S.C. 154(b) by 0 days.

(21) Appl. No.: 12/257,451

(22) Filed: Oct. 24, 2008

(65) Prior Publication Data

US 2009/0111300 A1 Apr. 30, 2009

(30) Foreign Application Priority Data

Oct. 30, 2007 (FR) ..... 07 07640

(51) Int. Cl.
*H01R 4/66* (2006.01)
*H01R 13/648* (2006.01)

(52) U.S. Cl. ..... 439/98; 439/610

(58) Field of Classification Search ..... 439/98, 439/99, 100, 95, 96, 607.41, 607.42, 607.44, 439/607.45, 607.48, 607.5, 761, 827, 939
See application file for complete search history.

(56) References Cited

U.S. PATENT DOCUMENTS

| | | | | |
|---|---|---|---|---|
| 4,342,497 | A * | 8/1982 | Morrison | 439/522 |
| 4,557,545 | A | 12/1985 | Ohtsuki et al. | |
| 4,790,765 | A * | 12/1988 | Ehrenfels et al. | 439/96 |
| 5,199,891 | A | 4/1993 | Reed | |
| 5,402,315 | A | 3/1995 | Reichle | |
| 5,949,020 | A * | 9/1999 | Mitchell et al. | 174/40 CC |
| 6,142,828 | A | 11/2000 | Pepe | |
| 2001/0046809 | A1 | 11/2001 | Chiran | |

* cited by examiner

*Primary Examiner*—Hae Moon Hyeon
(74) *Attorney, Agent, or Firm*—Harness, Dickey & Pierce, PLC

(57) ABSTRACT

The invention concerns a connector for an armoured cable, this connector comprising a socket body and a conductive earthing member, the socket body being designed to receive a multi-conductor plug and comprising a wall element conformed so as to be in contact with this plug, and the earthing member comprising a band gripping the armouring of the cable and an elongate element electrically connecting the band to the socket body. According to the invention, the elongate element is flexible and the band takes the form of an open elastic clamp designed so as to be forcibly fitted on the armouring of the cable.

7 Claims, 3 Drawing Sheets

RAPID-INSTALLATION CONNECTOR FOR AN ARMORED CABLE

FIELD

The present invention, in general terms, concerns the field of connector technology.

More precisely, the invention concerns a connector for a multi-conductor cable carrying electrically conductive external armouring, this connector comprising a rigid conductive socket body and a conductive earthing member, the socket body being designed to be receive a multi-conductor plug and comprising at least one wall element conformed so as to be in contact with this plug, the earthing member comprising a band at least partially gripping the armouring and an electrically conductive elongate element connecting the band to the socket body in order to take the wall element to the electrical potential of the armouring.

BACKGROUND

A connector of this type is for example described in the U.S. Pat. No. 4,557,545.

SUMMARY

The purpose of the present invention is to propose a connector whose fitting is more rapid and ergonomic than that of this known connector, whilst conferring greater compactness on the assembly obtained.

To this end, the connector of the invention, also in accordance with the generic definition given to it by the above preamble, is essentially characterized in that the band takes the form of an open elastic clamp designed to be forcibly fitted on the armouring, and in that the elongate element is flexible.

In the most simple embodiment, the socket body and/or the clamp are metal.

Preferably, the elongate element is a rod forcibly inserted in a housing in the socket body.

The elastic clamp comprises for example two wings with a partially circular transverse section, symmetrical with each other and having respective free ends at which they separate from each other.

The elastic clamp is advantageously produced by the bending and conformation of a single metal blank.

Moreover, it may be judicious to provide for this elastic clamp to have a fold in which the rod is inserted and welded, this fold being able to connect the two wings of this clamp to each other.

DRAWINGS

Other characteristics and advantages of the invention will emerge clearly from the description given of it below, by way of indication and in no way limitatively, with reference to the accompanying drawings, in which.

DETAILED DESCRIPTION

Figure 1:
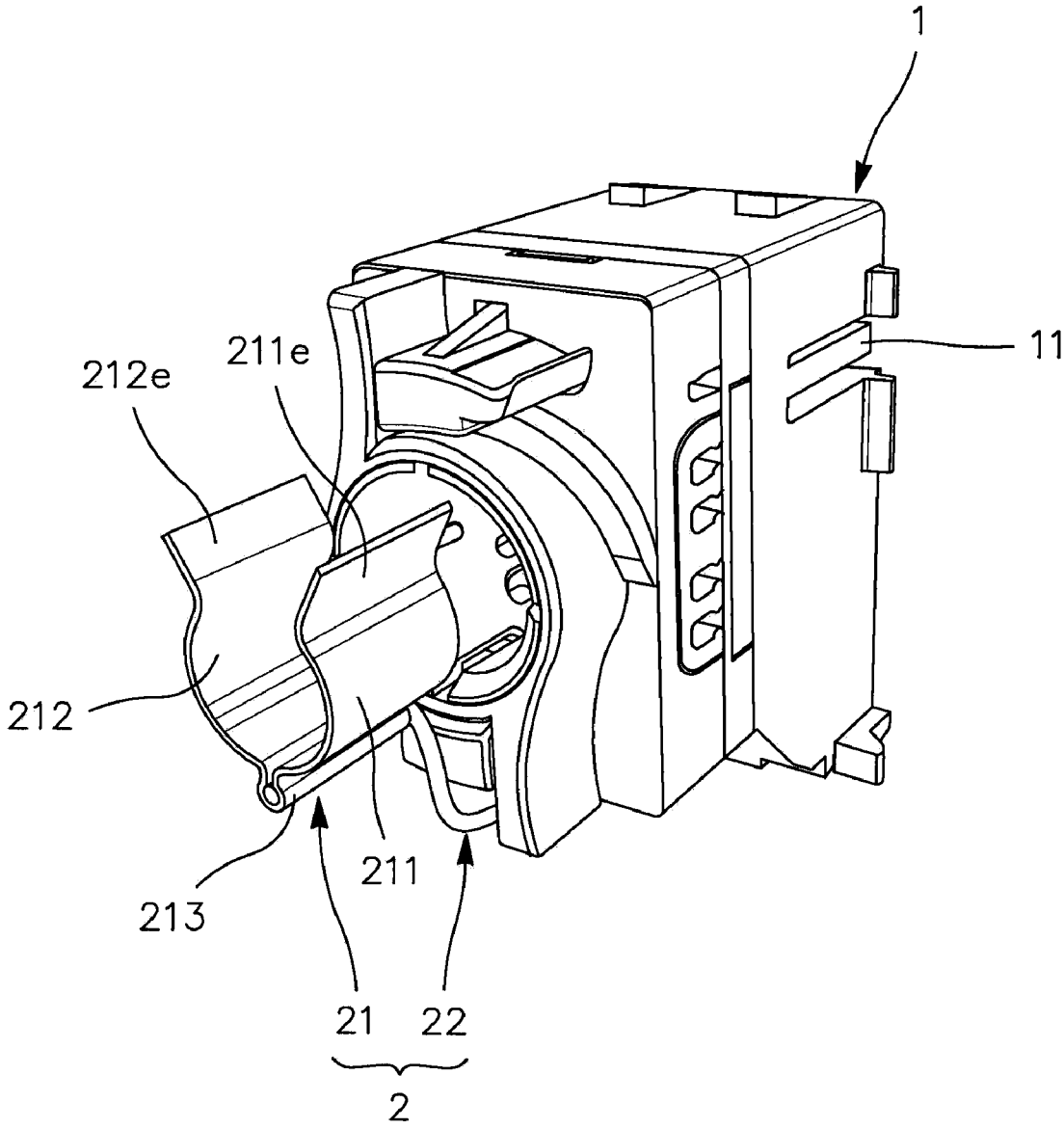
FIG. 1 is a first perspective view of a connector according to the invention, observed at a lateral angle, on the side through which it receives a multi-conductor cable.
Figure 2:
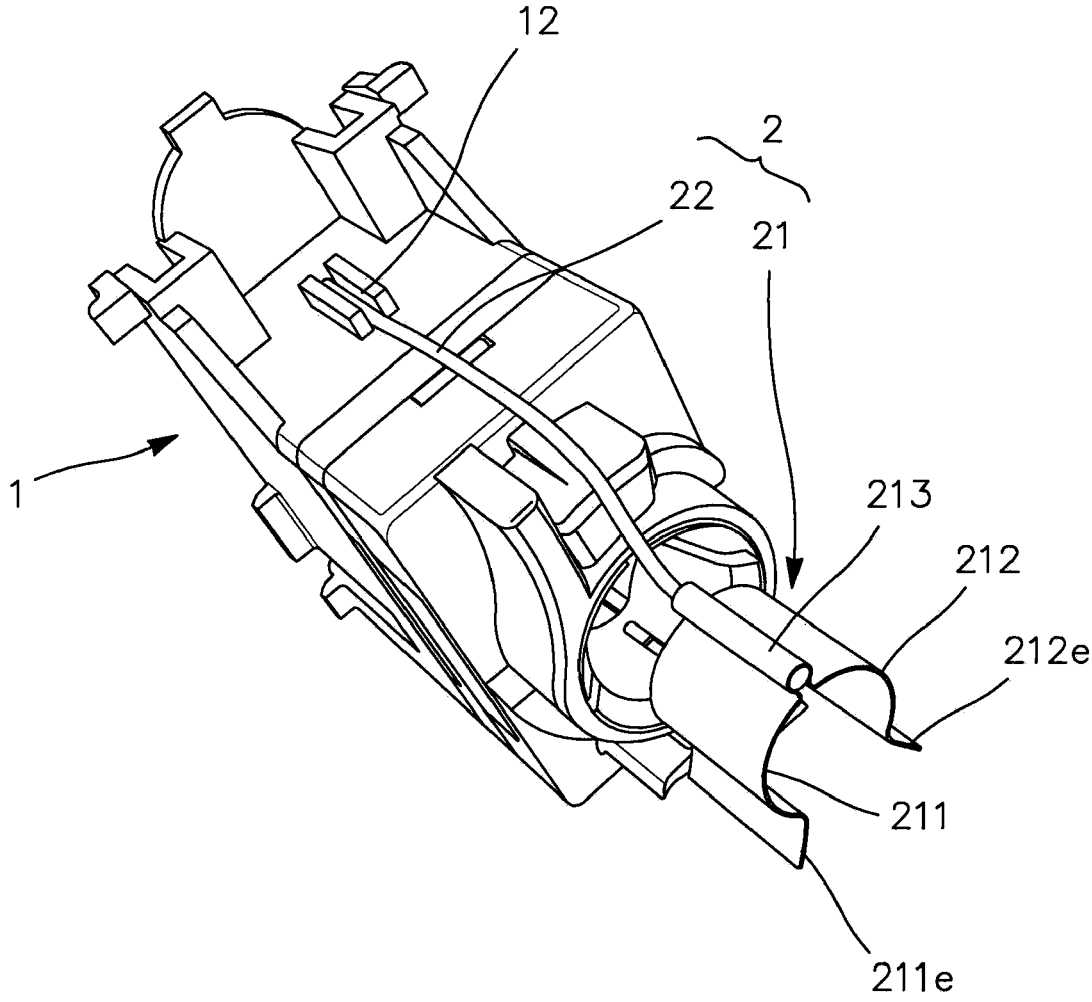
FIG. 2 is a second perspective view of the same connector, observed at a downward angle, on the side through which it receives the cable.
Figure 3:
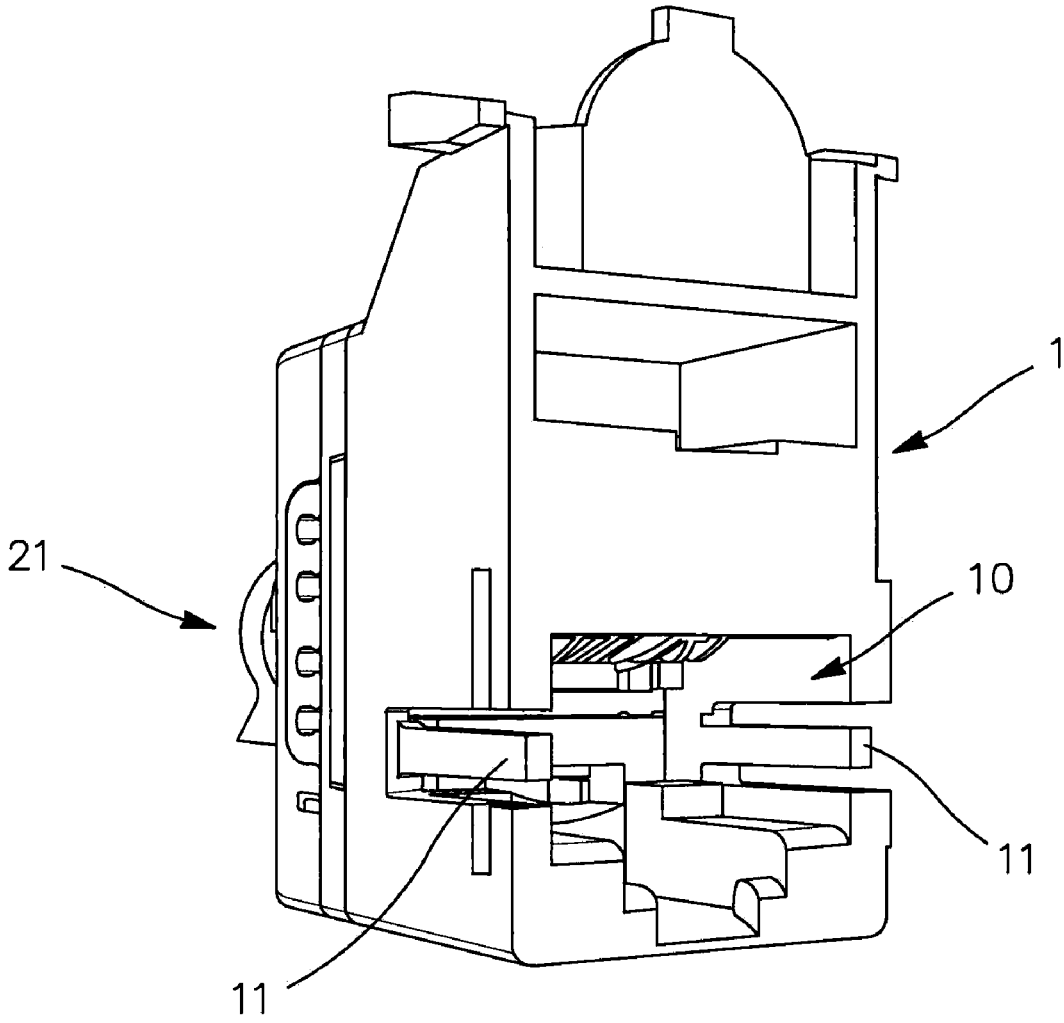
FIG. 3 is a third perspective view of the same connector, observed at a lateral angle, on the side through which it receives a multi-conductor plug.

As stated previously, the invention concerns a connector intended to equip a multi-conductor cable (not shown) carrying electrically conductive external armouring.

Such a connector comprises essentially a rigid conductive socket body 1 and a conductive earthing member 2.

The socket body 1 is designed to receive a multi-conductor plug (not shown), inserted in the opening 10.

This socket body 1 also comprises one or more wall elements 11 conformed so as to be in contact with this plug, these wall elements taking the form of elastic lateral lugs in the embodiment illustrated.

The earthing member 2 comprises a band 21 designed to at least partially grip the armouring of the cable, and an elongate element 22 that connects the band 21 to the socket body 1.

The elongate element 22, which is electrically conductive, has the effect of taking the wall element 11 to the electrical potential of the armouring.

According to the invention, the elongate element 22 is flexible and the band 21 takes the form of an open elastic clamp designed to be forcibly fitted on the armouring of the cable.

In the most simple embodiment, the socket body 1, the clamp 21 and the elongate element 22 are produced from metal or a metal alloy, one or more of these elements however being able to consist of a polymer or a mixture of polymers containing fibres or metal particles so as to be electrically conductive.

In the preferred embodiment, which corresponds to the embodiment illustrated, the elongate element 22 is in the form of a rod forcibly inserted in a housing 12 in the socket body 1.

In addition, the elastic clamp 21 can be produced by bending and conforming a single metal blank, these operations possibly being followed by quench hardening.

The elastic clamp 21 advantageously comprises two wings 211 and 212 symmetrical with each other and having a partially circular transverse section so as to closely grip together the armouring of the cable over an angular sector with an angle at the centre greater than 180 degrees and for example around 270 degrees.

These wings 211 and 212 are connected to each other by a fold 213 and having, at a distance from this fold, respective free ends 211*e* and 212*e*, at which these wings separate from each other in order to allow the insertion between them of the cable provided with its armouring.

The fold 213, which fulfils two functions, is moreover conformed so as to receive the rod 22, which is welded in this fold after having been inserted therein.

What is claimed is:

1. A connector for a multi-conductor cable carrying electrically conductive external armouring, the connector comprising:

a rigid conductive socket body and a conductive earthing member, the socket body being designed to receive a multi-conductor plug and comprising at least one wall element conformed so as to be in contact with this plug, the earthing member comprising a band at least partially gripping the armouring and an electrically conductive elongate element connecting the band to the socket body in order to take the wall element to the electrical potential of the armouring, characterised in that the band takes the form of an open elastic clamp designed so as to be forcibly fitted on the armouring, in that the elongate element is flexible, and in that the elastic clamp comprises two wings with a partially circular transverse section, symmetrical with each other and having respective free ends at which the two wings are separated from each other.

2. The connector according to claim 1, characterised in that the socket body is metal.

3. The connector according to claim 1, characterised in that the clamp is metal.

4. The connector according to claim 2, characterised in that the elongate element is a rod forcibly inserted in a housing in the socket body.

5. The connector according to claim 1, characterised in that the elastic clamp is produced by bending and conforming a single metal blank.

6. The connector according to claim 4, characterised in that the elastic clamp has a fold in which the rod is inserted and welded.

7. The connector according to claim 6, characterised in that the fold in the elastic clamp connects the two wings of this clamp to each other.

* * * * *